US007104216B2

(12) United States Patent
Suzuki et al.

(10) Patent No.: US 7,104,216 B2
(45) Date of Patent: Sep. 12, 2006

(54) COATING LIQUID APPLICATION APPARATUS FOR INK-PRINTED MEDIUM AND IMAGE PRINTING APPARATUS HAVING SAME

(75) Inventors: Yoshiaki Suzuki, Kanagawa (JP); Nobuhiko Takekoshi, Kanagawa (JP); Tetsuo Kikuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 10/196,357

(22) Filed: Jul. 17, 2002

(65) Prior Publication Data

US 2003/0024474 A1 Feb. 6, 2003

(30) Foreign Application Priority Data

Jul. 19, 2001 (JP) ..... 2001/220487
Jul. 15, 2002 (JP) ..... 2002/206224

(51) Int. Cl.
*B05C 1/08* (2006.01)

(52) U.S. Cl. ..... 118/46; 118/122; 118/126; 118/236; 118/249; 118/259; 118/260; 118/266; 118/268; 118/DIG. 1; 347/101; 101/424.2

(58) Field of Classification Search ..... 118/101, 118/46, 121, 122, 123, 126, 236, 249, 259, 118/260, 266, 267, 268, DIG. 1; 101/424.2; 347/101; 399/324, 325, 326; 427/258, 288, 427/428; 156/277, 384, 385, 386, 387; 15/256.5, 15/256.51

See application file for complete search history.

(56) References Cited

U.S. PATENT DOCUMENTS

| | | | | |
|---|---|---|---|---|
| 3,940,238 | A * | 2/1976 | Bar-on | 432/75 |
| 4,908,670 | A * | 3/1990 | Ndebi | 399/325 |
| 4,994,862 | A * | 2/1991 | Hoover | 399/325 |
| 5,476,043 | A * | 12/1995 | Okuda et al. | 101/483 |
| 5,826,296 | A * | 10/1998 | Steven | 15/256.51 |
| 5,881,348 | A * | 3/1999 | Onodera et al. | 399/325 |
| 6,091,923 | A * | 7/2000 | Yamamuro | 399/324 |
| 6,120,199 | A | 9/2000 | Takekoshi | |
| 6,183,079 | B1 * | 2/2001 | Meade et al. | 347/101 |

FOREIGN PATENT DOCUMENTS

JP 64-85766 3/1989

* cited by examiner

*Primary Examiner*—Laura Edwards
(74) *Attorney, Agent, or Firm*—Fitzpatrick, Cella, Harper & Scinto

(57) ABSTRACT

A coating liquid application apparatus is capable of automatically and properly applying to a printed surface of a print medium a coating liquid, such as coating materials that improve weatherability of the printed surface. For that purpose, the apparatus includes a pair of rollers in rotating contact with both surfaces of the print medium, one of the rollers in contact with a printed surface of the print medium being used as an application roller, and a coating liquid supply member to supply the coating liquid stored in a coating liquid reservoir to the application roller.

8 Claims, 13 Drawing Sheets

COATING LIQUID APPLICATION APPARATUS FOR INK-PRINTED MEDIUM AND IMAGE PRINTING APPARATUS HAVING SAME

This application is based on Japanese Patent Application Nos. 2001-220487 filed Jul. 19, 2001 and 2002-206224 filed Jul. 15, 2002, the contents of which are incorporated hereinto by reference.

BACKGROUND OF THE INVENTION

1. Field of the Invention

The present invention relates to an apparatus for applying a coating liquid to an ink-printed surface of a print medium to improve its weatherability and glossiness, and to an image printing apparatus having the coating liquid application apparatus.

2. Description of the Related Art

In recent years, an ink jet system has been spotlighted as a printing system that can easily produce an image quality almost identical with that of a silver salt picture. An ink jet system using a dye ink in particular has an excellent color reproducibility and can produce a high image quality equal to or even higher than that of a silver salt picture system. Such a printing system using an ink, however, has a problem that an output printed medium has poor weatherability and is known to fade when subjected to light, gases, such as ozone, and water. Conventional measures proposed to cope with this problem include laminating a printed medium on which an image was formed and improving the weatherability of the ink itself that contains a coloring material.

Although the weatherability is getting better gradually, it still remains in an unsatisfactory range when looked at in a long term. To perform the laminate processing on a printed medium to improve its weatherability, a post processing device is needed which can easily be handled by the user and which can automatically laminate the print medium. In realizing such a post processing device, the following problems are encountered.

First, there is a problem of running cost. The laminate processing generally involves bonding to the print medium under pressure or by heat a transparent film, larger in size than the print medium, which is coated with an adhesive. Hence, when the size changes, excess portions must be removed, increasing the running cost.

A second problem is an installation space for the post processing device. In performing the laminate processing, the post processing device needs a space therein in which to form a laminate film in advance in conformity with the shape of a cartridge for easy replacement or in which to cut the laminated print medium, and also a space in which to accommodate an excess laminate material. This in turn increases the size of the post processing device and requires a large space for its installation.

SUMMARY OF THE INVENTION

An object of the present invention is to provide an image printing apparatus capable of maintaining an original image for a long period of time without degrading its image quality by directly coating a printed medium with a visible, transparent layer.

Another object of the present invention is to provide a coating liquid application apparatus capable of automatically and appropriately applying to a printed surface of a print medium a coating liquid such as a coating material for improving a weatherability of the printed surface, and also an image printing apparatus incorporating the coating liquid application apparatus.

Still another object of the present invention is to provide a coating liquid application apparatus for applying a liquid coating material or coating liquid to a print medium printed with an ink image, the apparatus comprising a pair of rollers in rotating contact with both surfaces of the print medium, one of the rollers in contact with a printed surface of the print medium being used as an application roller and a coating liquid supply means to supply the coating liquid stored in a coating liquid reservoir to the application roller.

A further object of the present invention is to provide a coating liquid application apparatus for applying a liquid coating material or coating liquid to a print medium printed with an ink image, the apparatus comprising a pair of rollers in rotating contact with both surfaces of the print medium, one of the rollers in contact with a printed surface of the print medium being used as an application roller, a coating liquid supply means to supply the coating liquid stored in a coating liquid reservoir to the application roller and a coating liquid restriction means to limit the coating liquid supplied to the application roller to an arbitrary amount.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1A:
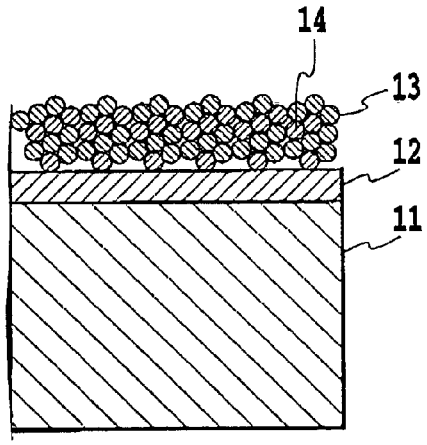
FIG. 1A is a partial cross-sectional view showing a distribution of a coating liquid that is applied to a print medium in an insufficient mount.

Now, embodiments of the present invention will be described by referring to the accompanying drawings.

(First Embodiment of Coating Liquid Application Apparatus)

Referring to FIGS. 1A to 1D and FIG. 3, a first embodiment of the coating liquid application apparatus according to the present invention will be described.

After an image is formed on an ordinary ink jet print medium (described later) by a general ink jet printing apparatus, a post-processing apparatus of the first embodiment protects (mainly provides a weatherability to) a printed surface of the print medium, on which the image was formed, by applying a protection liquid (coating liquid) to the printed surface and letting it soak into the surface.

First, by referring to the cross-sections of FIGS. 1A–1D, an explanation will be given to a mechanism by which the protection liquid of this invention is applied to and soaks into the printed medium.

In FIG. 1, reference numbers 11, 12 and 13 represent base paper, a reflection layer and an ink reception layer, respectively. FIGS. 1A, 1B, 1C and 1D show states of the coating liquid when the coating liquid is applied in an amount short of an appropriate level (FIG. 1A), in an appropriate amount (FIG. 1B), in a slightly excessive amount (FIG. 1C), and in a significantly excessive amount (FIG. 1D). Reference numerals 14, 15, 16 and 17 represent distributions of the protection liquid in the cross-sectional direction in the respective states. Examinations have found that the state of FIG. 1A is not desirable because an optical density is low due to diffused reflection, a durability is not improved and the degree of penetration of the liquid varies with the elapse of time. In the states of FIG. 1B and FIG. 1C, the optical density is found to have increased, making the formed image clear, and the durability is excellent. In the state of FIG. 1D, the optical density and the durability are both excellent but some stains are observed in light-colored images. Hence, the state of FIG. 1D is not desirable.

Figure 1B:
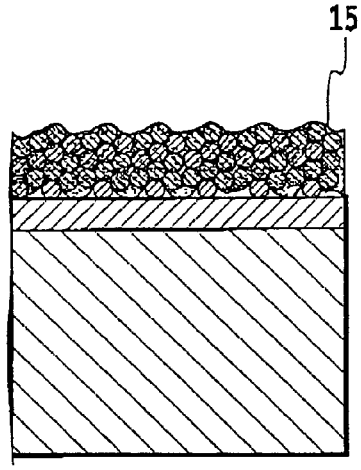
FIG. 1B is a partial cross-sectional view showing a distribution of a coating liquid that is applied to a print medium in an appropriate amount.
Figure 1C:
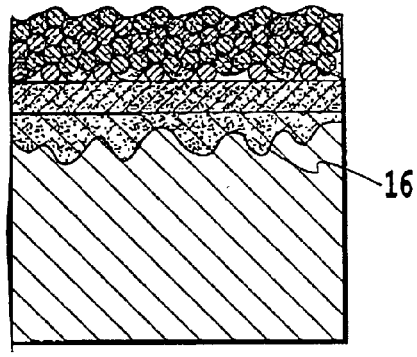
FIG. 1C is a partial cross-sectional view showing a distribution of a coating liquid that is applied to a print medium in a slightly excessive amount.
Figure 1D:
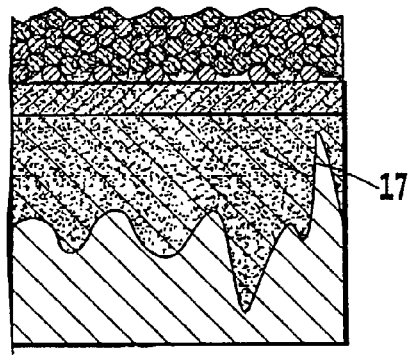
FIG. 1D is a partial cross-sectional view showing a distribution of a coating liquid that is applied to a print medium in a significantly excessive amount.

As described above, when a print medium used as a liquid carrier has a surface that can absorb the protection liquid, it is particularly desired that the medium assume a final state over the entire surface in which oil fills only the ink reception layer as shown in FIG. 1B, or the ink reception layer and a part of the carrier as shown in FIG. 1C.

Here, with reference to FIG. 3, the layer structure of the print medium used in this embodiment will be explained.

The print medium shown here is a so-called dedicated ink jet print medium which has a base material 180 of paper coated on both surfaces with resin layers 181*a*, 181*b* of, for example, polyethylene and further coated on one of the resin layers with an ink reception layer 182 as shown.

This print medium may have the ink reception layer 182 coated on both of the resin layers 181*a*, 181*b* or may have the resin layer formed on only one of the surfaces of the base material 180.

Figure 3:
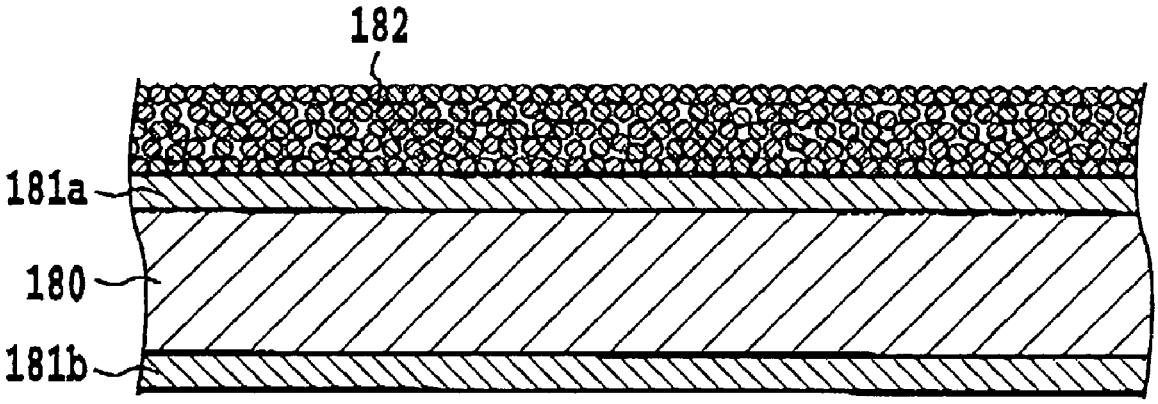
FIG. 3 is an explanatory, vertical cross-sectional side view showing an example layer structure of a print medium as applied to the embodiment of the present invention.

It is noted, however, that coating the resin layer over a surface opposite the ink reception layer 182 (i.e., back surface), too, as shown in FIG. 3 can produce the following effects. One such effect is to prevent a coating liquid from penetrating into the base material 180 from the back surface during a coating liquid application process (described later) and then forming stains. Another effect is that, when coated print mediums are stacked one upon the other with their printed surfaces facing in the same direction, the coating liquid applied to the surface (printed surface) of one print medium can be prevented from being absorbed by the back surface of a print medium lying immediately above. Such effects can be produced in structures other than that shown in FIG. 3. For example, similar effects can be expected when the ink reception layer 182 is formed over a film of polyethylene terephthalate or glass.

As described above, the provision on the print medium of a layer of the material, such as resin, through which the coating liquid hardly penetrates into the base material can produce an effect of preventing ink from penetrating excessively into the base material and forming stains.

This embodiment is also effectively applied to other print mediums, such as those having no resin layers. When a print medium with no resin layer is to be used, measures to deal with the penetration of the applied coating liquid into the base material include reducing the amount of the coating liquid to prevent the liquid from penetrating into the base material, and using as the base material a material which does not clearly show the coating liquid even if it penetrates or a material into which the coating liquid can hardly penetrate.

The materials of the ink reception layer 182 and the resin layers 181*a*, 181*b* and the coating method may employ commonly proposed ones, and there are no particular limitations on the layer structure of the print medium and on the method of fabricating it.

Preferred coating liquids to be applied to the print mediums include dimethyl silicone oils, silicone oils modified by such functional groups as phenyl and alkyl groups, and ester-based oil and varnish. Inert and transparent liquids are more preferable. That is, the use of an inert coating liquid can suppress problems that would otherwise be caused by various reactions during the handling of the liquid, and the use of a transparent coating liquid can suppress changes in hue of the printed image after being applied with the coating liquid.

This embodiment uses a liquid of dimethyl silicone oil with a dynamic viscosity of 20 centipoise (0.02 mPa·s) to which 5% of ultraviolet absorber is added, and sets the amount of coating liquid to be applied to the print medium at 1.3 g/A4 (i.e., 1.3 g of coating liquid is applied to each A4-size print medium). This was found to be able to provide the coated print medium with a water repellency and to produce an effect of suppressing the ink fading due to exposure to ultraviolet light.

When the dimethyl silicone oil used as a coating liquid has a dynamic viscosity of 400 centipoise (0.4 mPa·s) or less, the oil can be applied at a low speed. When on the other hand the viscosity is too low, the molecular weight of the coating liquid generally decreases and it evaporates naturally when left to stand even at room temperatures, giving rise to a difficult problem in terms of maintenance. Hence, this embodiment used an oil with a viscosity of 20 centipoise (0.02 mPa·s), which proved more preferable. The examination using the dimethyl silicone oil found that the preferable range of viscosity is 20–50 centipoise (0.02–0.05 mPa·s). Selection of an optimum viscosity in this range slightly varies depending on whether the oil is heated or not or to what ink reception layer the oil is applied. For example, if the oil is heated to an elevated temperature, the oil at 20 centipoise (0.02 mPa·s) has a relatively low flash point, which poses a safety problem. At 50 centipoise (0.05 mPa·s), a commonly used viscosity of dimethyl silicone oil, the oil can be used at higher temperatures.

When the ink reception layer of the print medium is 1–100 micron thick, a sufficient optical density can be obtained to produce a picture quality image. The amount of liquid to be applied to the print medium per unit area is determined by a thickness and a void volume of the print medium. More specifically, 0.1–10 mg/cm$^2$ is an applicable range and a 0.5–4 mg/cm$^2$ range is preferred.

Figure 2:
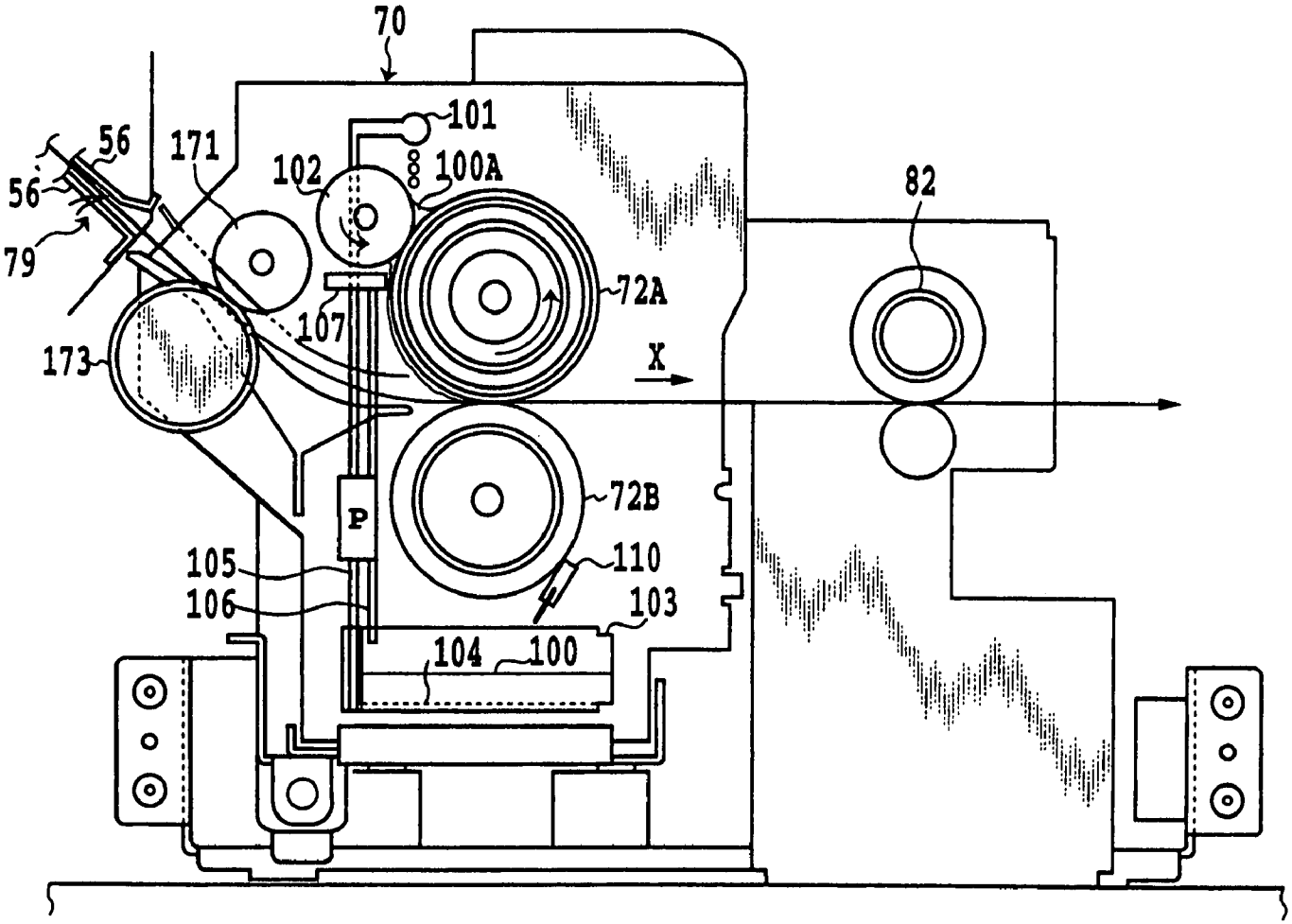
FIG. 2 is an explanatory, vertical cross-sectional view showing a first embodiment of a coating liquid application apparatus according to the present invention.

FIG. 2 is an explanatory vertical cross-sectional side view showing a coating liquid application apparatus of the first embodiment that applies the coating liquid to a printed surface of the print medium described above.

In the figure, when the print medium described above is inserted into an inlet guide 56 with its surface formed with an image (ink reception layer 182 side) facing up, a medium sensor 79 detects the inserted print medium, thus initiating a coating liquid application sequence.

A coating liquid 100 is stored in a coating liquid tank 103 in advance, as shown. The coating liquid 100 is pumped up by a pump P through a pipe 105 to a drip member 101 arranged in a top part of the apparatus. The drip member 101 is a pipe extending in a direction perpendicular to a print medium feed direction X (direction perpendicular to the plane of a sheet of the drawing). The pipe 105 has small holes formed in the circumferential surface thereof at almost equal intervals in a longitudinal direction. Thus, the coating liquid 100 pumped up to the drip member 101 drops almost uniformly over the entire length of the drip member 101 through its small holes and is received by an application roller 72A and an application restriction roller 102, both located below the drip member 101. The coating liquid 100 thus received by the two rollers 72A and 102 passes through a gap between the rollers 72A and 102 and adheres to the application roller 72A. The coated print medium is then fed to a pair of opposing discharge rollers 82 arranged downstream of the application roller 72A. At this time, the application restriction roller 102 is rotating in the same direction as the application roller 72A so that a resistance is imparted to the coating liquid 100 as it passes through the gap between the rollers 72A and 102. Hence, a puddle 100A of the dripped coating liquid is formed between the rollers 72A and 102, as shown in FIG. 2. That is, while forming a puddle between the rollers 72A, 102, the coating liquid is fed down the rollers' gap. If there are some variations in the coating liquid dripping condition, the puddle 100A can absorb the variations completely, ensuring that an appropriate amount of the coating liquid is almost uniformly applied to the application roller 72A.

Further, in this embodiment a gap of 0.2 mm is formed between the application roller 72A and the application restriction roller 102. This produced a satisfactory result. It is desired that the gap be optimized according to the amount of coating liquid applied to the print medium. The protective performance can be secured if the amount of coating liquid applied is enough to fill the voids in the ink reception layer. In this embodiment in which the ink reception layer is 30 microns thick, a satisfactory result is obtained when the amount of coating liquid applied is in the range of between 1.0 g/A4 and 2 g/A4. An optimum result is produced when the amount is within a range of between 1.2 g/A4 and 1.5 g/A4. For example, when the amount of coating liquid is small, there is no need to provide a gap. Depending on the roller configuration, a certain amount of contact area (nip width) may preferably be provided between the application roller 72A and the application restriction roller 102. The size of the gap therefore is not limited to a fixed value. Further, although in this embodiment the application restriction member is described to be constructed as a rotatable roller-shaped member, it is not limited to the above construction. For example, the application restriction member may have a shape of a circular cylinder, a semicircular cylinder or a plate, and be fixed and brought into engagement with the application roller 72A. That is, the application restriction member may have any desired construction as long as it can cooperate with the application roller to form the puddle 100A of the coating liquid and still supply a desired amount of coating liquid uniformly onto the application roller.

The print medium inserted from the inlet guide 56 is carried by the paired feed rollers 171, 173 to an engagement portion (hereinafter referred to as a nip portion) between the application roller 72A and the feed roller 72B. After having reached the nip portion between the application roller 72A and the feed roller 72B, the print medium is clamped between the rollers 72A, 72B, that are rotating in the opposite directions at the same speeds, and is fed in the direction X. At this time, the print medium is applied with the coating liquid 100 that was adhering to the application roller 72A. Because the coating liquid uniformly adheres to the application roller 72A, as described earlier, it is uniformly applied to the print medium.

In this process, if the engagement pressure between the application roller 72A and the feed roller 72B is set high enough or the hardness of at least one of the rollers is set low enough (making the nip width large enough) so that the coating liquid can hardly pass through the nip portion, a puddle of the coating liquid can be formed immediately upstream of the nip portion, too. In that case, the puddle thus formed ensures that a more uniform coat is formed on the print medium.

The coating liquid application apparatus of this embodiment is contemplated to use print mediums that are intended to be printed on only one side (front surface), as shown in FIG. 3, and thus has a construction such that the coating liquid is not applied in large quantity to the back surface of the print medium. That is, a print medium such as shown in FIG. 3 has a resin layer 181*b* on its back that prevents the coating liquid 100 from being absorbed into the back surface. Hence, if the coating liquid is applied to the back surface, it gives an uncomfortable sticky feeling to the user and degrades the writability of the medium, the adhesion with paste and the ease of handling. To deal with this problem, a rubber blade 110 is arranged below the feed roller 72B for wiping off the coating liquid 100, as shown in FIG. 2. This cleaning member may be made of a variety of kinds of materials, such as resin and metal, and also formed in the shape of brush and roller rather than a platelike blade. Further, an absorbing member such as nonwoven cloth may be brought into engagement with the feed roller 71B. As described above, the cleaning member may have any desired construction as long as it can effectively remove the coating liquid. Further, this embodiment is so constructed that the coating liquid 100 scraped off by the cleaning member drops into and gets recovered in the coating liquid tank 103 and is further passed through a filter 104 to remove impurities such as paper dust.

Not only during the coating liquid application operation is this filter means (filter 104) used to remove impurities, it can also be applied to other operations (such as a cleaning mode) whereby the coating liquid 100 is circulated through the filter means to remove impurities deposited on the application roller 72A and the feed roller 72B. With this arrangement, since the cleaning means are provided to individual members to remove impurities and deposit them at one location, the impurity removal operation can be performed efficiently.

A coating liquid receiver 107 Is provided below and out of contact with the application restriction roller 102. When the coating liquid 100 drips excessively onto an area between the application restriction roller 102 and the application roller 72A (or onto either of them) and excess coating liquid falls from these rollers, the liquid is received by the coating liquid receiver 107 from which it is immediately recovered to the coating liquid tank 103 through a discharge pipe 106. With this arrangement, the coating liquid can be circulated in the apparatus at all times, thus preventing a wasteful discarding of the coating liquid.

The application roller 72A used in this embodiment is a rubber roller which has a silicone rubber 1 mm thick wound on the surface of an aluminum core. The feed roller 72B has a foamed sponge arranged on an aluminum core with a PFA tube fitted over the outermost surface thereof. The application restriction roller 102 is constructed of a metal roller of, for example, aluminum.

Hence, because of the silicone rubber the application roller 72A can maintain the wettability of its surface for dimethyl silicone oil, the main component of the coating liquid 100. The feed roller 72B has an enhanced water repellency because of the surface layer of fluoride resin and thus can minimize the amount of coating liquid applied to the back surface of the print medium. And the application restriction roller 102, because it is made of a metal, can provide an increased precision for a gap. With this embodiment, therefore, not only can an appropriate amount of coating liquid be applied uniformly to the surface of the print medium, but the coating liquid can be prevented from adhering to the back surface of the print medium. As a result, the coating liquid application apparatus of this embodiment can produce an easy-to-handle printed output with an excellent weatherability.

(Second Embodiment of Coating Liquid Application Apparatus)

Next, a second embodiment of the present invention will be described.

The first embodiment has been described with dimethyl silicone oil taken as the main component of the coating liquid. This oil, although it has an excellent thermal stability, is not necessarily compatible with the ink reception layer (oil absorption rate and volume may not be large as desired). Hence, the second embodiment allows the use of fatty ester containing a pigment such as silica as a main component and compatible with the ink reception layer.

With this oil used as its main component, the coating liquid is absorbed in the ink reception layer faster than dimethyl silicon oil and thus has a feature of not feeling sticky immediately after its application. Therefore, the second embodiment uses saturated fatty ester as the main component of the coating liquid. In this case, the application mechanism may be the same as described above. However, the viscosity of saturated fatty ester generally has a higher temperature dependency than dimethyl silicone oil and thus the temperature dependency needs to be alleviated. This is realized in the second embodiment.

Figure 5:
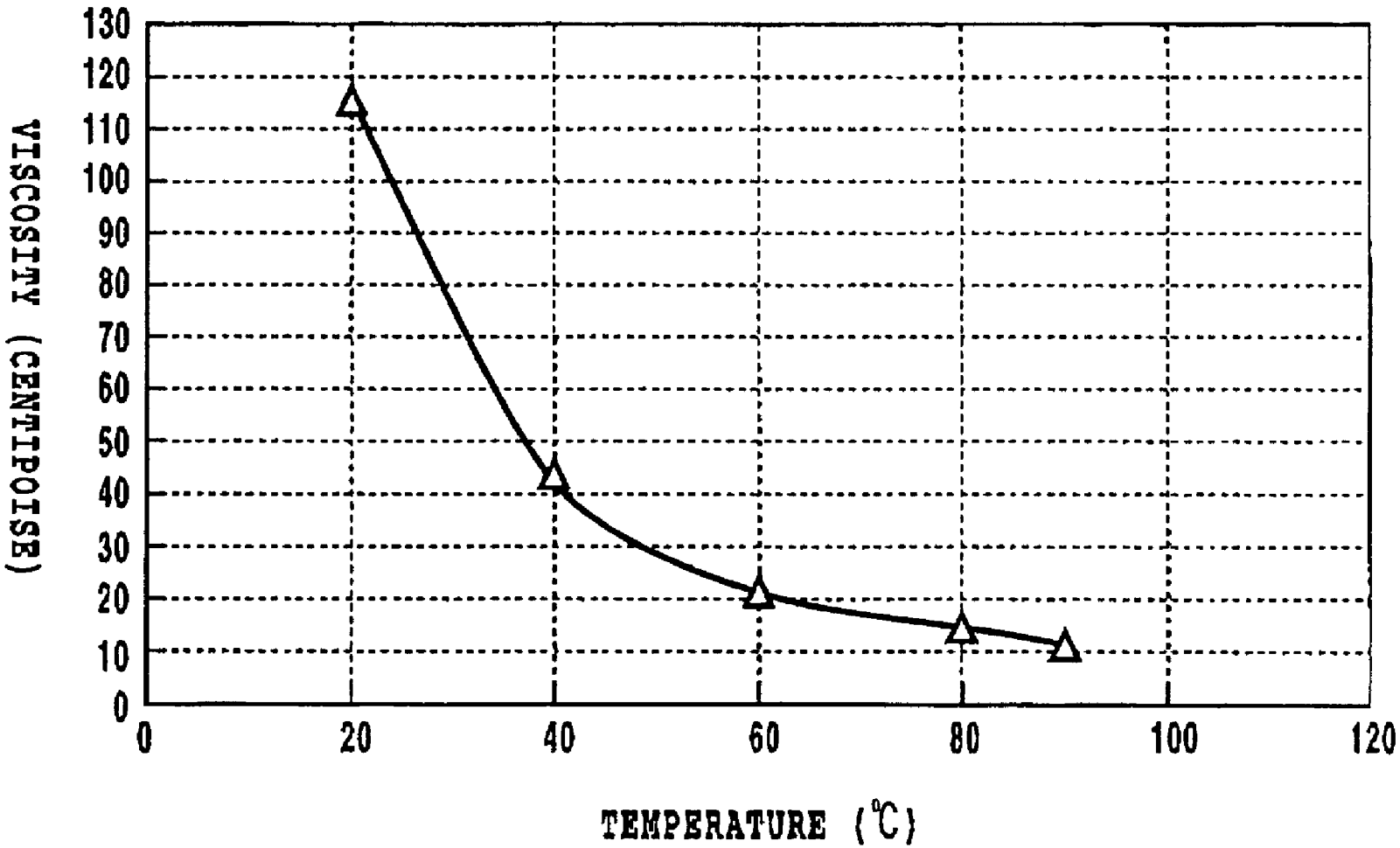
FIG. 5 is a graph showing a temperature-dependency of a viscosity of the coating liquid applied to the third embodiment of the coating liquid application apparatus according to the present invention.

FIG. 5 shows a relation between viscosity and temperature of saturated fatty ester. In the figure, the ordinate represents a viscosity (mPa·s) and the abscissa a temperature. As shown in the diagram, this oil has a large viscosity variation in and around a temperature range of 0° C. to 30° C., the environment in which the apparatus is normally operated. On the low temperature side of this range the viscosity is very high, which tends to reduce the amount of oil applied. On the high temperature side, on the contrary, the amount of oil applied tends to increase. One of the causes for this is that when the viscosity is high, the speed at which the coating liquid gets absorbed in the ink reception layer becomes slow (high viscosity reduces the fluidity of the coating liquid, making it difficult for the coating liquid to soak into the ink reception layer as in the capillary attraction). Another cause is that the reduced fluidity of the coating liquid reduces the amount of oil pumped up.

Figure 4:
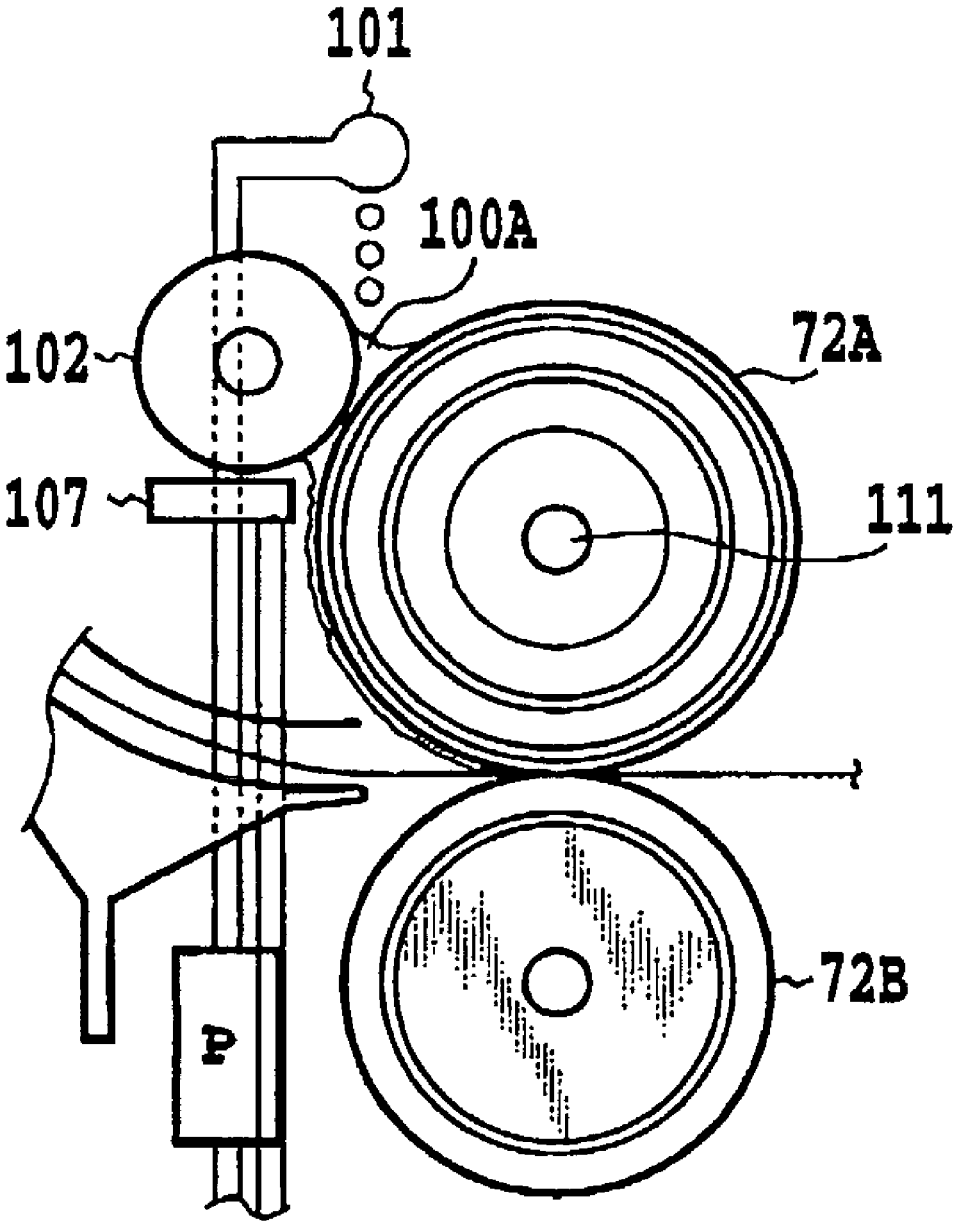
FIG. 4 is an explanatory, vertical cross-sectional side view showing an essential portion of a second embodiment of a coating liquid application apparatus according to the present invention.

To suppress variations in the amount of coating liquid applied due to temperature changes, as shown in FIG. 4 the second embodiment has a halogen heater (heating means) 111 arranged at the center of a rotating shaft of the application roller 72A to control the temperature of the application roller 72A at a desired constant value by a thermistor (not shown). Controlling the temperature to be high reduces the viscosity, allowing for rapid penetration and leveling. In this embodiment, the controlled constant temperature is set at 60±5° C. In other aspects the construction of this embodiment is similar to that of the first embodiment.

As described above, the second embodiment can realize a uniform, constant-volume application of the coating liquid at all times by heating the application roller 72A with the halogen heater 111 to minimize the dependency of the coating liquid on the environment (ambient temperature). Further, the second embodiment can also be applied to a coating liquid with a highly viscous oil as the main component whose absorption into the ink reception layer is so poor as will not justify its use (the absorption speed is so slow that the coating liquid takes several minutes to wet and soak into the ink reception layer). This allows even a coating liquid with low fluidity to be applied to the ink reception layer, which in turn makes it possible to stably maintain at least one of desired characteristics, such as weatherability, gas resistance, water resistance and high glossiness.

Although the second embodiment has described a case in which the portion heated by the heater is chosen to be the application roller, the most effective part, it is also possible to heat other portions. For example, the interior of the coating liquid tank may be heated to warm the coating liquid itself or the interior of the apparatus including pipes may be heated by hot air. When a construction is employed in which the liquid path system is almost entirely heated, grease and solid wax that is normally solid at room temperatures but has a melting point can be used as a coating material. That is, a coating material which is solidified except when applied to a print medium but liquefied during application can be used in this embodiment. Such a coating material has an advantage of becoming stable after application, thus assuring a long-lasting characteristics such as weatherability.

It is desired that the temperature to which the coating liquid is heated be increased as its viscosity (or melting point) increases. It is desirable in terms of heat efficiency that the point to be heated be set close to where the coating liquid is applied to the print medium (in this case the application roller 72A). Whether or not other locations need also be heated depends on the apparatus configuration including the temperature-dependency of viscosity of the coating liquid used.

(Third Embodiment of Coating Liquid Application Apparatus)

Next, a third embodiment of the coating liquid application apparatus according to the present invention will be described.

Figure 6:
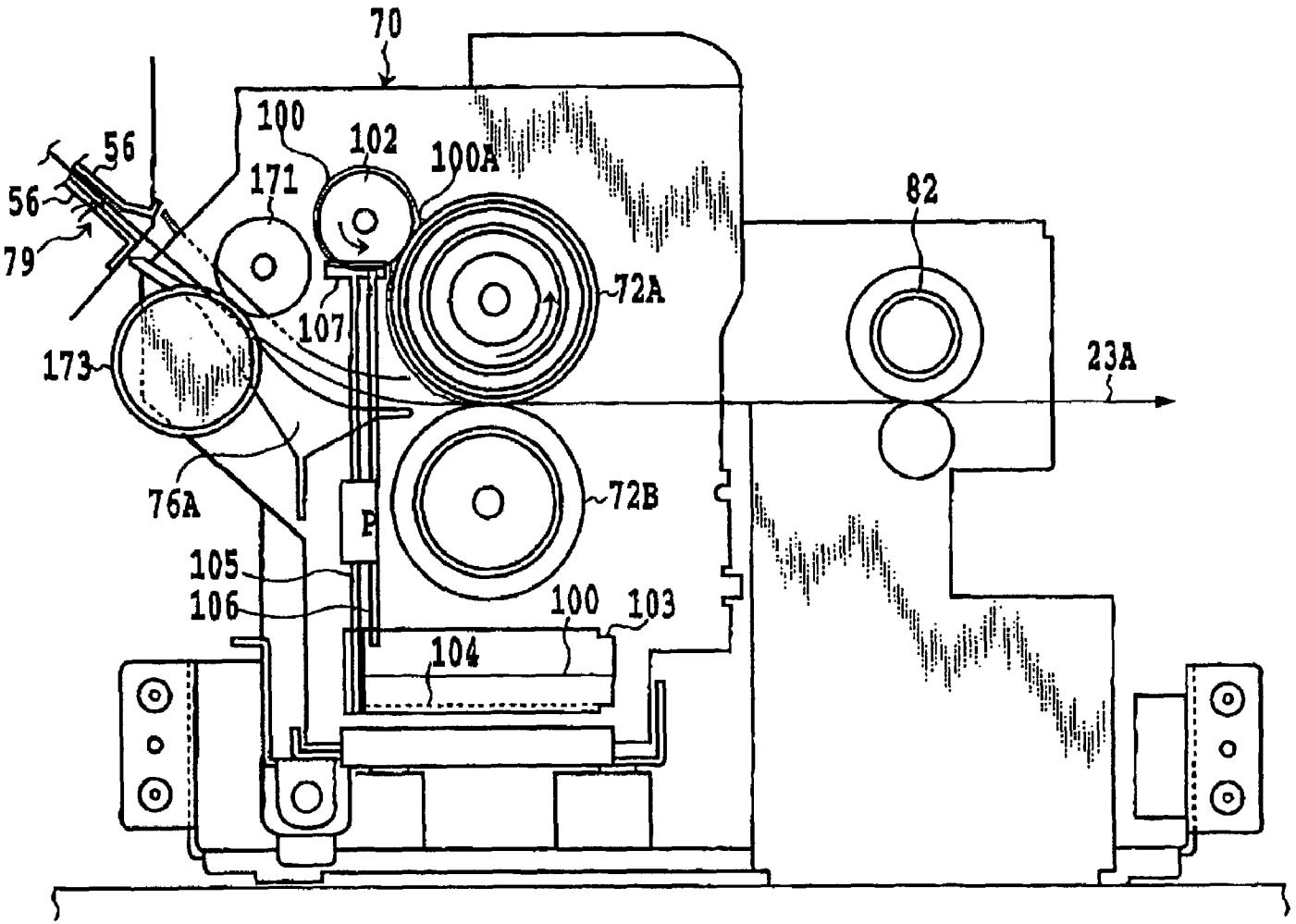
FIG. 6 is an explanatory, vertical cross-sectional side view showing a third embodiment of a coating liquid application apparatus according to the present invention.

While the preceding embodiments have adopted as a coating liquid application mechanism a construction in which the coating liquid is made to drop into an area between the application roller 72A and the application restriction roller 102, the third embodiment has at least a part of the application restriction roller 102 dipped in or in contact with the coating liquid contained in the coating liquid receiver 107, as shown in FIG. 6, rather than having the coating liquid drop onto the rollers 72A, 102.

The bottom of the coating liquid receiver 107 is connected with pipes 105, 106. The pipe 105 has an opening of its upper end situated at a bottom of the coating liquid receiver 107 and an opening of its lower end located close to a bottom of the coating liquid tank 103, with its intermediate portion connected with a pump. The other pipe 106 has an opening of its upper end situated at a predetermined position between a top opening of the coating liquid receiver 107 and the receiver bottom. An opening of the lower end of the pipe 106 is situated inside the coating liquid tank 103. The coating liquid in the coating liquid tank 103 is pumped up by the pump P to the coating liquid receiver 107 where the coating liquid then adheres to the application restriction roller 102 from which it is further transferred to the application roller 72A arranged close to or in contact with the application restriction roller 102. During this process, excess coating liquid adhering to the application restriction roller 102 which is then recovered to the coating liquid receiver 107 and the coating liquid pumped up by the pump P are accommodated in the coating liquid receiver 107. When the level of the coating liquid in the coating liquid receiver 107 exceeds a predetermined height, the coating liquid flows down the pipe 106 into the coating liquid tank 103. Thus, the liquid level in the coating liquid receiver 107 is kept at a predetermined height, which in turn keeps the contact between the liquid and the application restriction roller 102 in a steady state, thus ensuring a stable feeding of the coating liquid from the application restriction roller 102 to the application roller 72A.

In this embodiment, too, the application restriction roller 102 rotates in the same direction as the application roller 72A, which means that, at a gap portion between the opposing rollers 102 and 72A, their surfaces move in vertically opposite directions, thus forming a coating liquid puddle 100A between the rollers. At the puddle 100A, an appropriate amount of coating liquid uniformly adheres to the application roller 72A. In this way, in the third embodiment too, an appropriate amount of coating liquid can be applied uniformly to a print medium, providing the printed surface of the print medium with a satisfactory weatherability.

(Fourth Embodiment of Coating Liquid Application Apparatus)

Next, a fourth embodiment of the coating liquid application apparatus according to the present invention will be explained.

In the second embodiment, the coating material is heated or temperature-controlled by a heater. In the fourth embodiment, a print medium is heated prior to the coating liquid application in order to improve an ability of the print medium to absorb the coating liquid. This is particularly effective when used in an image printing apparatus described later which applies the coating liquid to the print medium immediately after printing.

Figure 7:
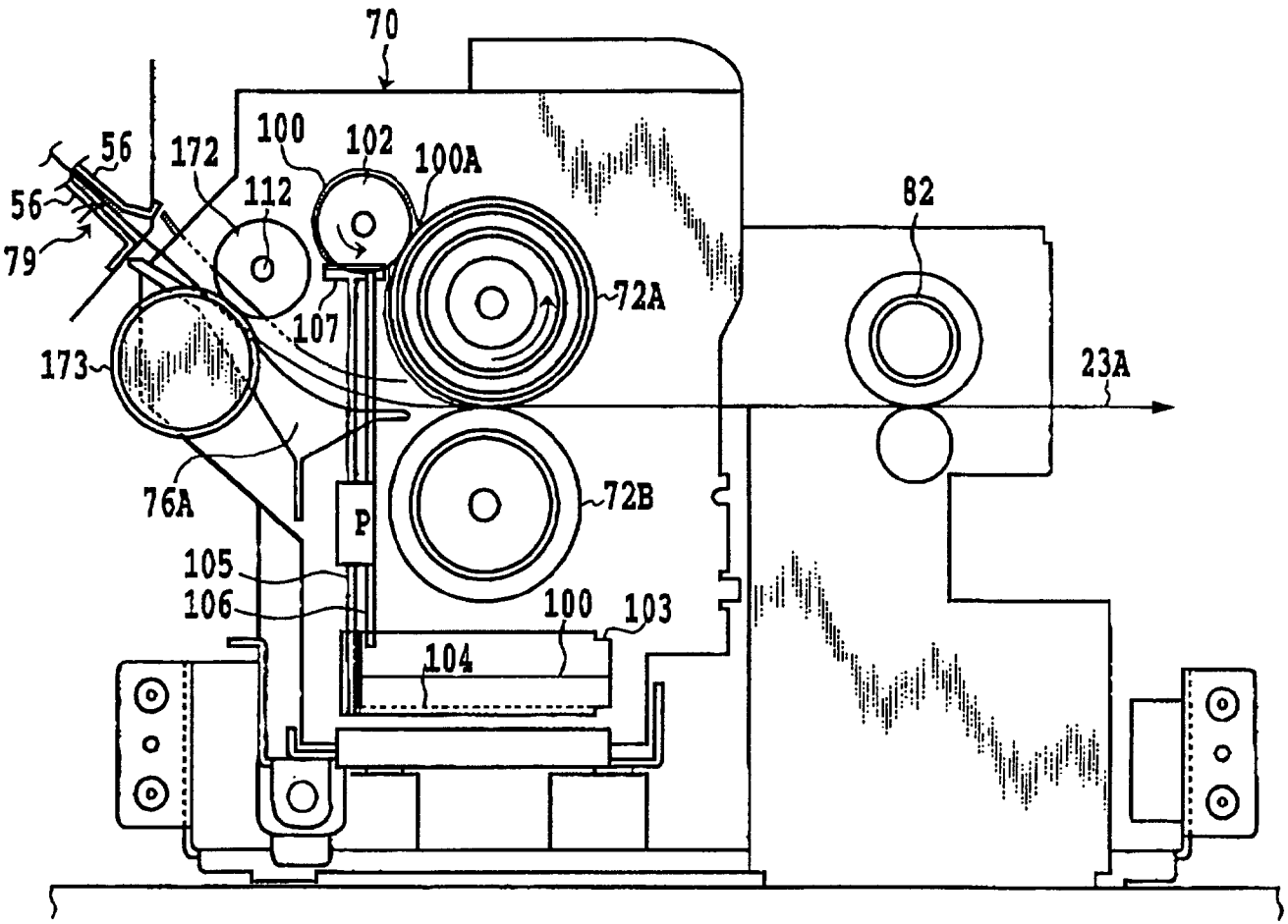
FIG. 7 is an explanatory, vertical cross-sectional side view showing a fourth embodiment of a coating liquid application apparatus according to the present invention.

FIG. 7 shows an explanatory vertical cross-sectional side view of the fourth embodiment. In this fourth embodiment, of a pair of feed rollers 172 and 173 that feed a print medium inserted from the inlet guide 56 to the application roller 72A, the feed roller 172 in contact with the surface of the print medium is used as an application promotion roller to improve the ability to absorb the coating liquid. The application promotion roller 172 incorporates a halogen heater 112 which is controlled by a temperature sensor, such as a thermistor (not shown), and a circuit that turns on or off heater power according to a signal from the temperature sensor. The surface temperature of the application promotion roller 172 is kept at 100° C. In other respects, the construction is similar to that of the first embodiment.

In the above construction, a printed medium 1 supplied from a speed adjusting means 50 (FIG. 8) is carried by the heated application promotion roller 172 and the opposing feed roller 173, during which time the ink reception layer formed on the surface of the printed medium is heated by the application promotion roller 172. As a result, excess water contained in the ink reception layer evaporates and the ink reception layer is warmed. Then, the coating liquid is applied to the surface of the print medium by the application roller 72A. At this time, since the ink reception layer is heated by the application promotion roller 172 and its water vaporized as described above, it can easily absorb a liquid. Further, the viscosity of the coating liquid is reduced by the heat of the print medium. Therefore, the coating liquid is very smoothly absorbed in the print medium.

The fourth embodiment has been described to have one halogen heater for heating the application promotion roller 172. The halogen heater may also be provided to the application roller 72A, as in the second embodiment, to heat both the print medium and the coating liquid. Further, the application promotion roller 172 may be applied with the coating liquid. In that case, a silicone oil may be used to produce an effect of easily releasing the print medium from the roller.

In the case where the coating liquid is applied by both of the application promotion roller 172 and the application roller 72A, these rollers do not necessarily have to use the same kind and amount of the coating liquid and the same application means. That is, they can apply different coating materials with different functions. For example, for the application promotion roller 172 a small amount, about 0.1–1.0 g/A4, of dimethyl silicone oil may be applied by giving importance to a releasability and a high-temperature stability. For the application roller 72A, a comparatively large amount, about 0.3–1.8 g/A4, of saturated fatty ester mixed with an ultraviolet absorber for an improved weatherability may be applied. This arrangement can offer an advantage that the individual coating liquids do not have to meet all of the total performance requirements, allowing a wider range of selection of the coating material, which in turn reduces the cost and enhances the function.

(Fifth Embodiment of Coating Liquid Application Apparatus)

Next, a fifth embodiment of the coating liquid application apparatus according to the present invention will be explained.

In the first to fourth embodiments, the supply of coating material to the surface of the application roller is made from the outside of the application roller, whereas this fifth embodiment supplies the coating material (liquid) to the interior of the application roller and has the coating liquid seep out through the surface of the application roller.

Figure 9:
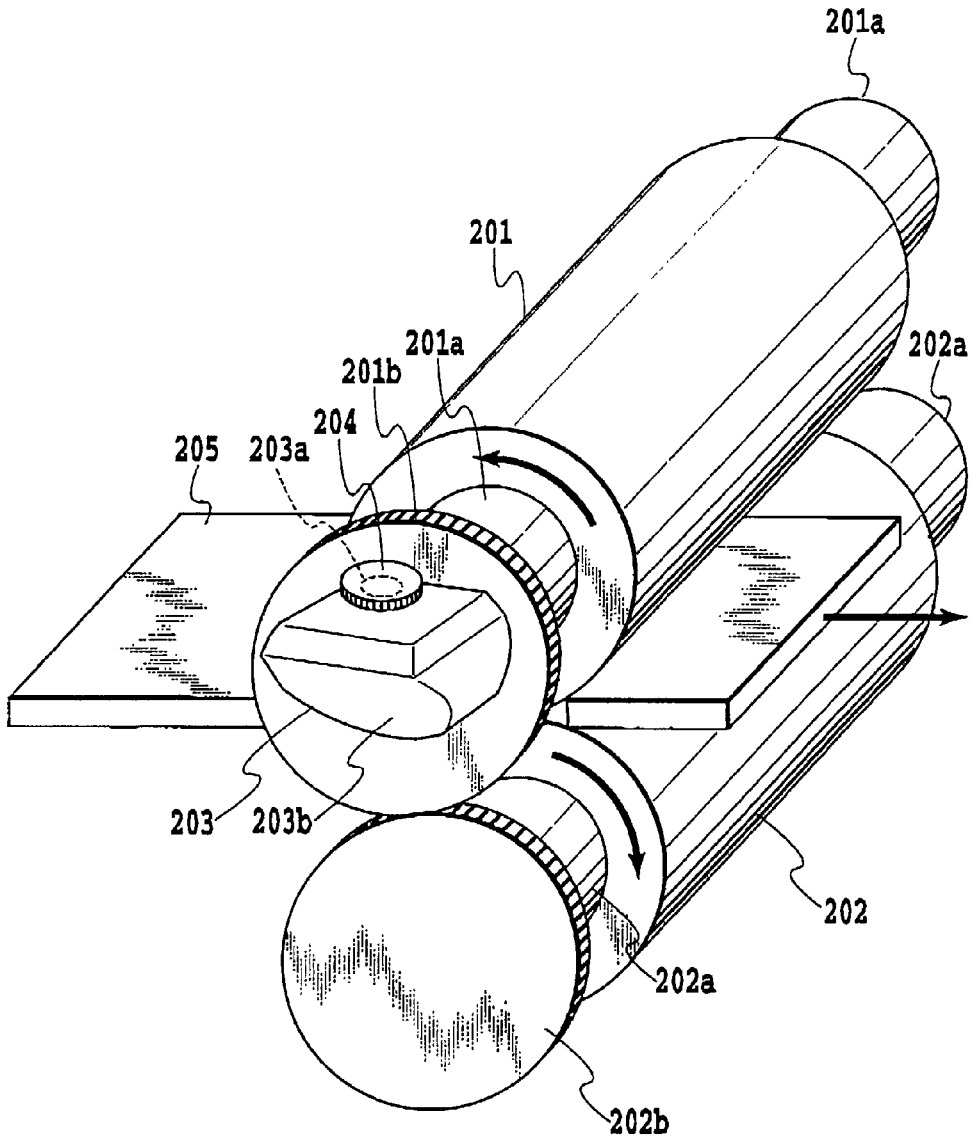
FIG. 9 is a perspective view of a fifth embodiment of a coating liquid application apparatus according to the present invention.
Figure 10:
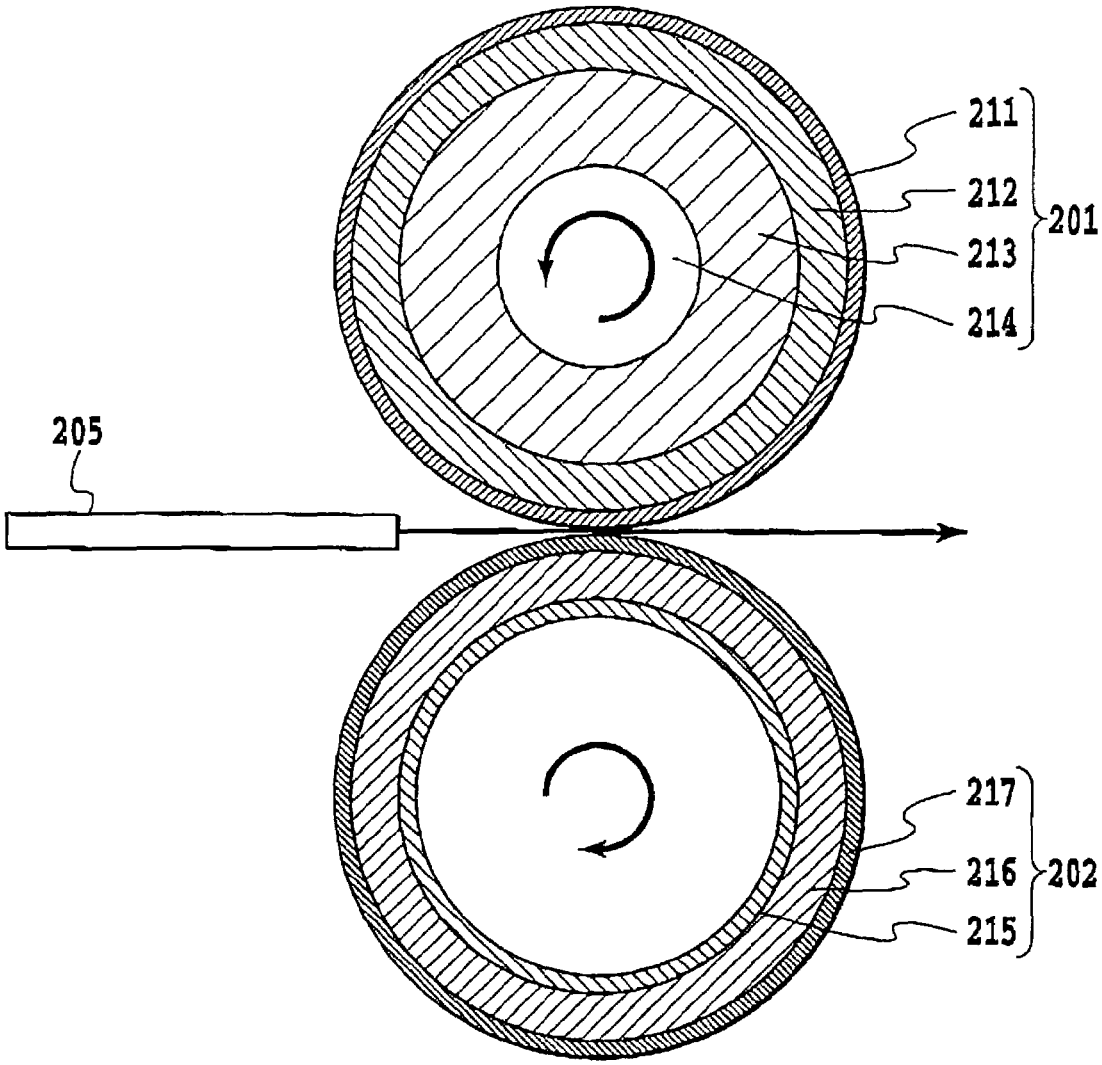
FIG. 10 is a cross-sectional view of what is shown in FIG. 9.

With reference to FIG. 9 and FIG. 10, the fifth embodiment of the coating liquid application apparatus according to this invention will be described in detail. FIG. 9 is a perspective view of the fifth embodiment and FIG. 10 is a cross-sectional view of FIG. 9.

As shown in FIG. 9, the coating liquid application apparatus of the fifth embodiment has a pair of opposing rollers 201, 202, with the roller 201 in contact with the surface of a print medium working as an application roller to apply the coating material (liquid) to the surface of the print medium. The coating liquid to be used in this embodiment includes, for example, fluorine oil, silicone oil, alkyl silicone oil and fatty ester. The other roller 202 opposing the application roller 202 is spaced a predetermined gap from the application roller 201.

From the sides of the rollers are projected cylindrical bodies 201*a*, 202*a* which are rigidly formed at one end with disklike gears 201*b*, 202*b* in mesh with each other. Hence, rotating the application roller 201 by a drive force of a motor (not shown) causes the other roller 202 to also rotate, thus clamping and feeding the print medium as they rotate.

The side surface of the gear 201*b* secured to the application roller 201 is rigidly attached with a tank 203 containing a coating liquid to be applied to the surface of the print medium. The tank 203 rotates together with the application roller 201. The tank 203 has a liquid inlet 203*a* formed on one surface which is closed with a cap 204.

The motor for driving the application roller 201 is controlled in such a manner that the application roller 201 always stops at a predetermined rotary position. That is, the application roller 201 is stopped at such a rotation phase that the liquid inlet 203*a* is situated at the highest position. Thus, when the application roller 201 is stopped, the tank supply port faces up, facilitating the injection of the coating liquid into the tank and preventing a possible leakage of the liquid when the cap 204 is removed. The rotation stop position of the application roller 201 is not limited to only one point but may be set in a certain range. In essence, the liquid inlet 203*a* needs only to stop in such a range as will prevent the coating liquid from leaking out of the liquid inlet 203*a*.

The tank 203 has its bottom surface (opposite the surface formed with the liquid supply port) 203*b* inclined downwardly from the outside toward the inside so that the coating liquid supplied into the tank is led by its own gravity toward the inside of the application roller 201 through the cylindrical body 201*a*. The tank 203 is formed of a transparent resin to allow the amount of coating liquid remaining inside to be visually checked.

The internal construction of each roller will be explained by referring to FIG. 10.

As shown in FIG. 10, the application roller 201 of the fifth embodiment has a hollow cylindrical structural body 213 with a rigidity that forms a skeleton of the application roller 201; an absorber 212 secured to the circumference of the structural body; and a film 211 held in intimate contact with the circumferential surface of the absorber 212. The film 211 is formed over its entire surface with fine holes that allow passage of the coating liquid.

The structural body 213 is made of a porous member through which the coating liquid can pass, and has the cylindrical bodies 201*a*, 201*a* secured to the ends of the hollow portion thereof The structural body 213 communicates with the tank 203 through one of the cylindrical bodies 201*a*. The structural body 213 may, for example, be formed by shaping a stainless mesh plate into a cylinder. Other porous members may also be used.

The absorber 212 is formed of elastic polypropylene (PP) fibers or a foamed sponge body and supports the surrounding film 211 with an appropriate elasticity.

The film 211 is made of polytetrafluoroethylene (PTFE) film formed over its entire surface with evenly distributed fines holes.

The opposing roller 202 comprises an aluminum core roll 215 at the center; an elastic cushion layer 216 made of PP fibers or foamed sponge body surrounding the core roll; and an oil-repellent, fluorine film 217 secured to the outer circumference of the cushion layer 216.

In the coating liquid application apparatus constructed as described above, when the application roller 201 stops rotating, the coating liquid supplied into the tank 203 flows along the inclined bottom of the tank 203 into the cylindrical body 201*a* and a path 214 formed inside the structural body 213 of the application roller 201. The coating liquid that has moved into the path 214 penetrates from the structural body 213 into the absorber 212 by the capillary attraction and then seeps from the back to the front surface of the film 211.

Then, a print medium with its printed surface facing up (toward the application roller side) is fed between the rollers 201, 202 that are rotated. As a result, the print medium is clamped between and fed by the rollers 201, 202. During this process, the film 211 of the application roller 201 presses uniformly against the printed surface of the print medium because of the elastic force of the absorber, thus uniformly applying the coating liquid that has seeped out to the roller surface. Further, during this coating liquid application operation, the tank 203 is rotated together with the application roller 201 but the leakage of the coating liquid from the tank 203 is prevented because the supply port of the tank 203 is closed by the cap 204.

Further, since the application roller 201 and the opposing roller 202 face each other with a predetermined gap therebetween, the coating liquid does not adhere to the opposite roller 202, which means that the back surface of the print medium is kept free of the coating liquid. Since fatty ester is used for the coating liquid, a sufficient image protection performance can be obtained.

A coating liquid application test was conducted in which the coating liquid application apparatus of this embodiment was used to apply the coating liquid to the print surface of a pseudo-boehmite ink jet print medium.

This test used an application roller 201 having a PTFE film 211 which is 50–200 microns thick and formed with 0.1–0.5 micron holes, and a coating liquid with a viscosity of 50–400 centipoise (0.05–0.4 mPa·s). The ink jet print medium used has an ink reception layer with an optically effective thickness of 1–100 microns or preferably 10–50 microns, and with 0.05–0.5 micron holes. The test results found that an appropriate amount of coating liquid was able to be applied uniformly, realizing a precise application of the coating liquid to the print medium.

(Sixth Embodiment)

Figure 12:
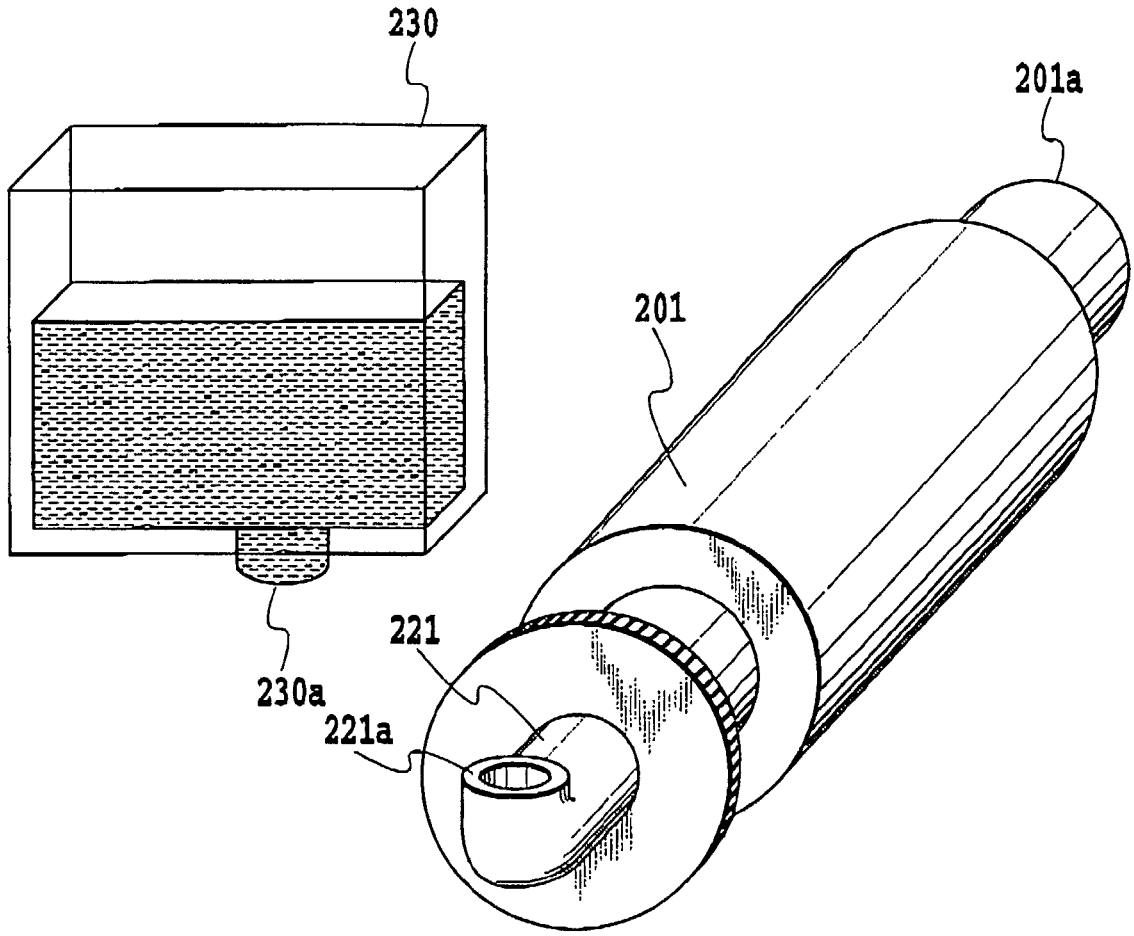
FIG. 12 is a perspective view showing an application roller of FIG. 11 and a tank.
Figure 13:
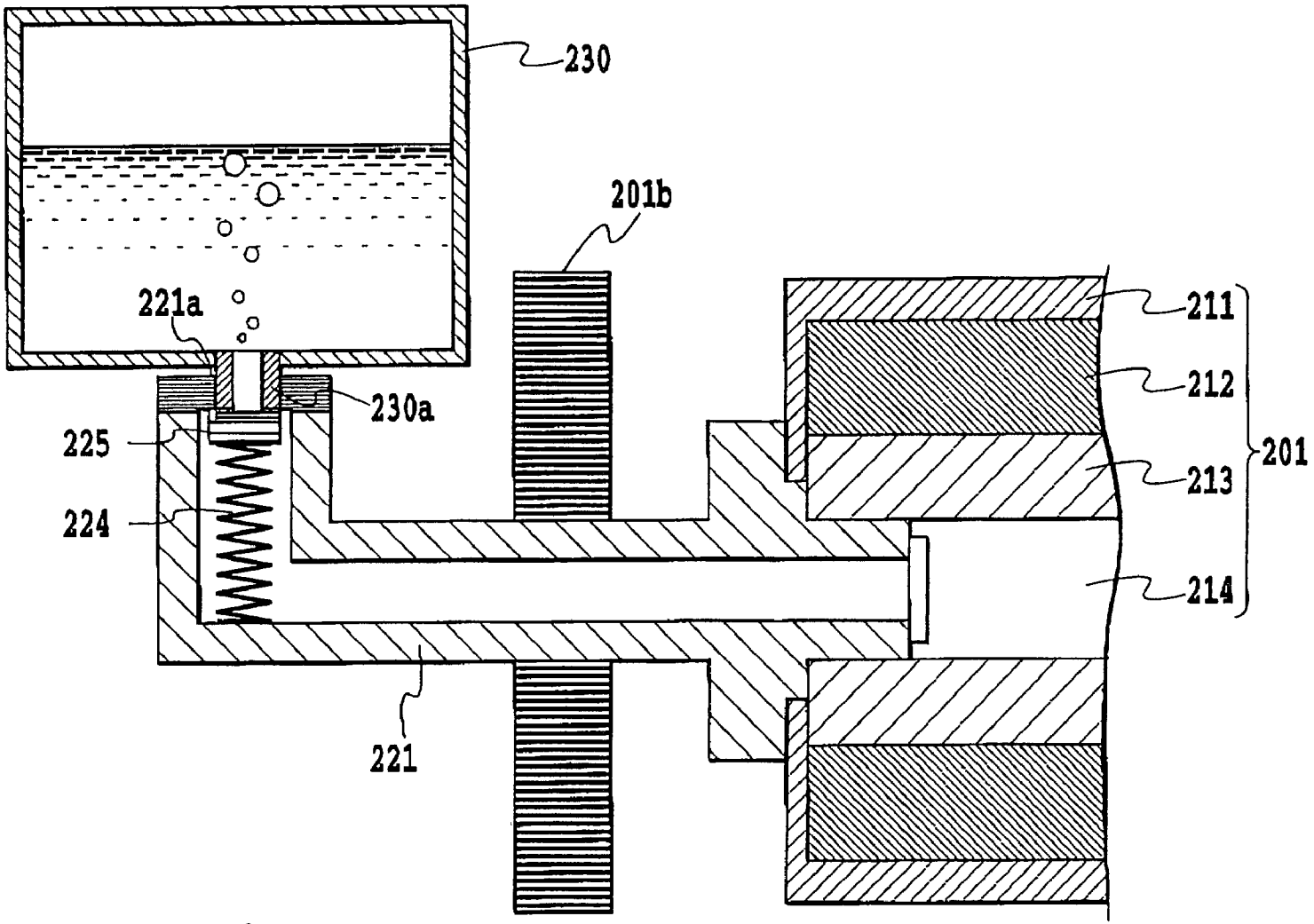
FIG. 13 is a cross-sectional view showing the tank of FIG. 12 mounted to the application roller.

Next, a sixth embodiment of the coating liquid application apparatus according to the present invention will be described by referring to FIG. 11 to FIG. 13.

The coating liquid application apparatus of the sixth embodiment is characterized in that the tank used in the fifth embodiment is made detachable so that during the coating liquid application operation the tank can be removed from the application roller. FIG. 11 is a perspective view of the coating liquid application apparatus as the sixth embodiment of the invention, FIG. 12 is a perspective view showing the application roller and the tank of FIG. 11, and FIG. 13 is a cross-sectional view showing the tank of FIG. 12 mounted to the application roller. In these figures, like reference numerals are assigned to parts identical to those of the fifth embodiment, and their detailed descriptions are omitted here.

Figure 11:
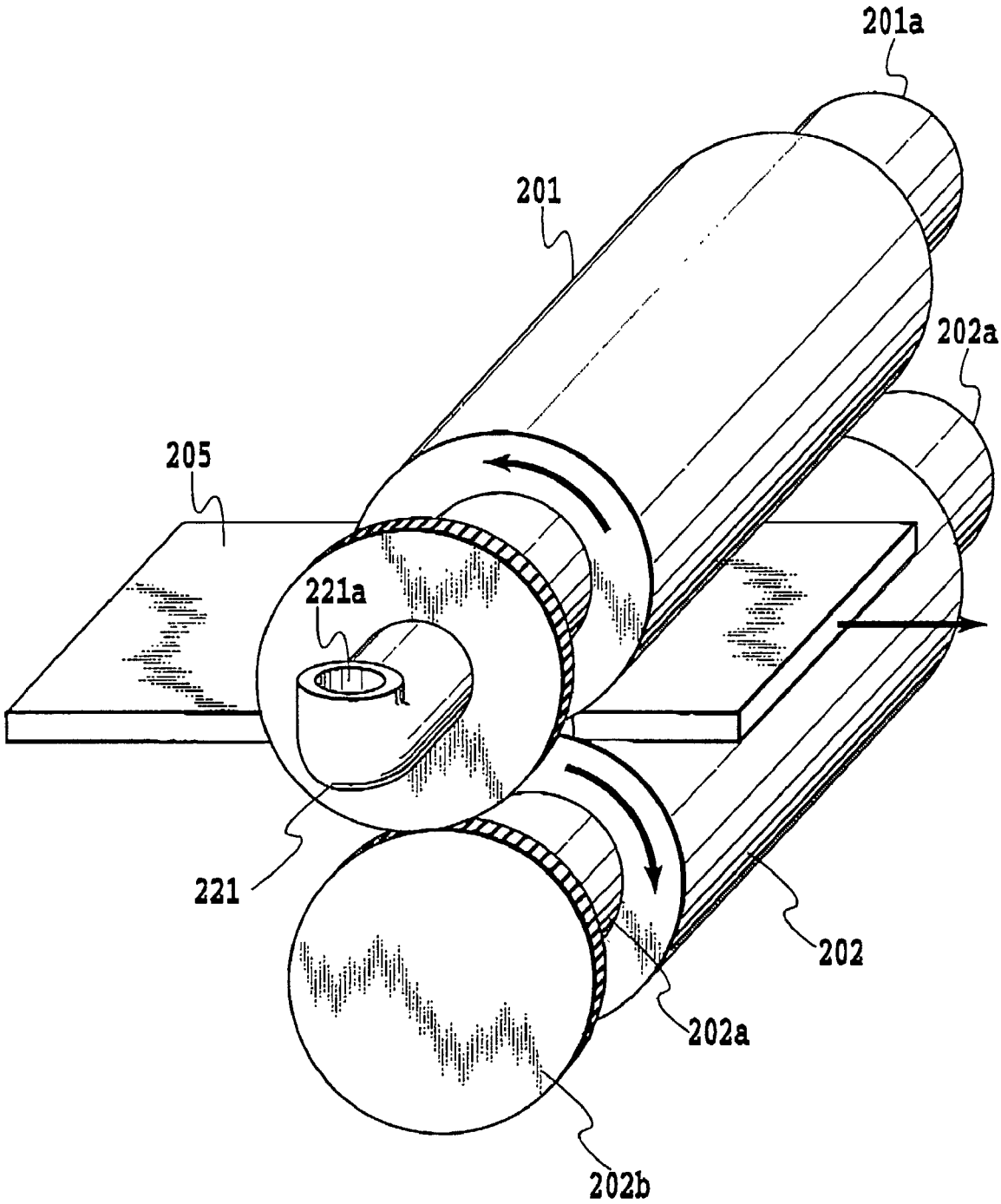
FIG. 11 is a perspective view of a sixth embodiment of a coating liquid application apparatus according to the present invention.

As shown in FIG. 11, the coating liquid application apparatus of the sixth embodiment has a pair of opposing rollers 201, 202 as in the fifth embodiment, with the roller 201 in contact with the surface of the print medium functioning as an application roller to apply the coating material (liquid) to the surface of the print medium. The constructions of these rollers are similar to those of the fifth embodiment.

It is noted, however, that the sixth embodiment differs from the fifth embodiment in that a cylindrical body 221 extending through a gear 201*b* outwardly is secured to one end of the application roller 201.

The cylindrical body 221 has one of its ends communicate with the path 214 of the application roller 201. The other end of the cylindrical body 221 protruding outwardly from the gear 201*b* is bent almost at right angles, with its opening functioning as a liquid supply port 221*a*. This liquid supply port is opened and closed by a valve 225 and a spring 224 that urges the valve 225.

The tank 230 in the sixth embodiment is formed of a transparent member to allow the level of the coating liquid inside to be visually checked and has a cylindrical discharge portion 230*a* downwardly protruding from its bottom. The discharge portion 230*a* is inserted into the opening of the cylindrical body 221, pushing down the valve 225 against the force of the spring 224 to supply the coating liquid from the tank 230 into the application roller 201 through the cylindrical body 221. It is desired that a scale or measuring line be provided to the side surface of the tank 230 for a visual check on the amount of the coating liquid remaining in the tank or the amount supplied from the tank to the application roller 201.

When the discharge portion 230*a* of the tank 230 is pulled out of the liquid supply port 221*a* of the cylindrical body 221, the spring 224 forces the valve 225 to hermetically close the liquid supply port 221*a* of the cylindrical body 221, thus preventing the coating liquid from flowing out of the liquid supply port 221*a* when the application roller 201 rotates.

The drive motor for the application roller 201 is so controlled that when the application roller 201 stops, the liquid supply port 221*a* faces up in order to ensure that the liquid will not leak from the liquid supply port when the tank is removed or attached.

With the coating liquid application apparatus of the sixth embodiment, it is therefore possible to uniformly apply an appropriate amount of coating liquid to the print medium as in the fifth embodiment and to replenish a large amount of coating liquid relatively easily by replacing the tank 230. This embodiment is thus effective in performing the coating liquid application to a large number of printed sheets.

(Embodiment of Image Printing Apparatus)

Now, one embodiment of the image printing apparatus according to the present invention will be explained.

Figure 8:
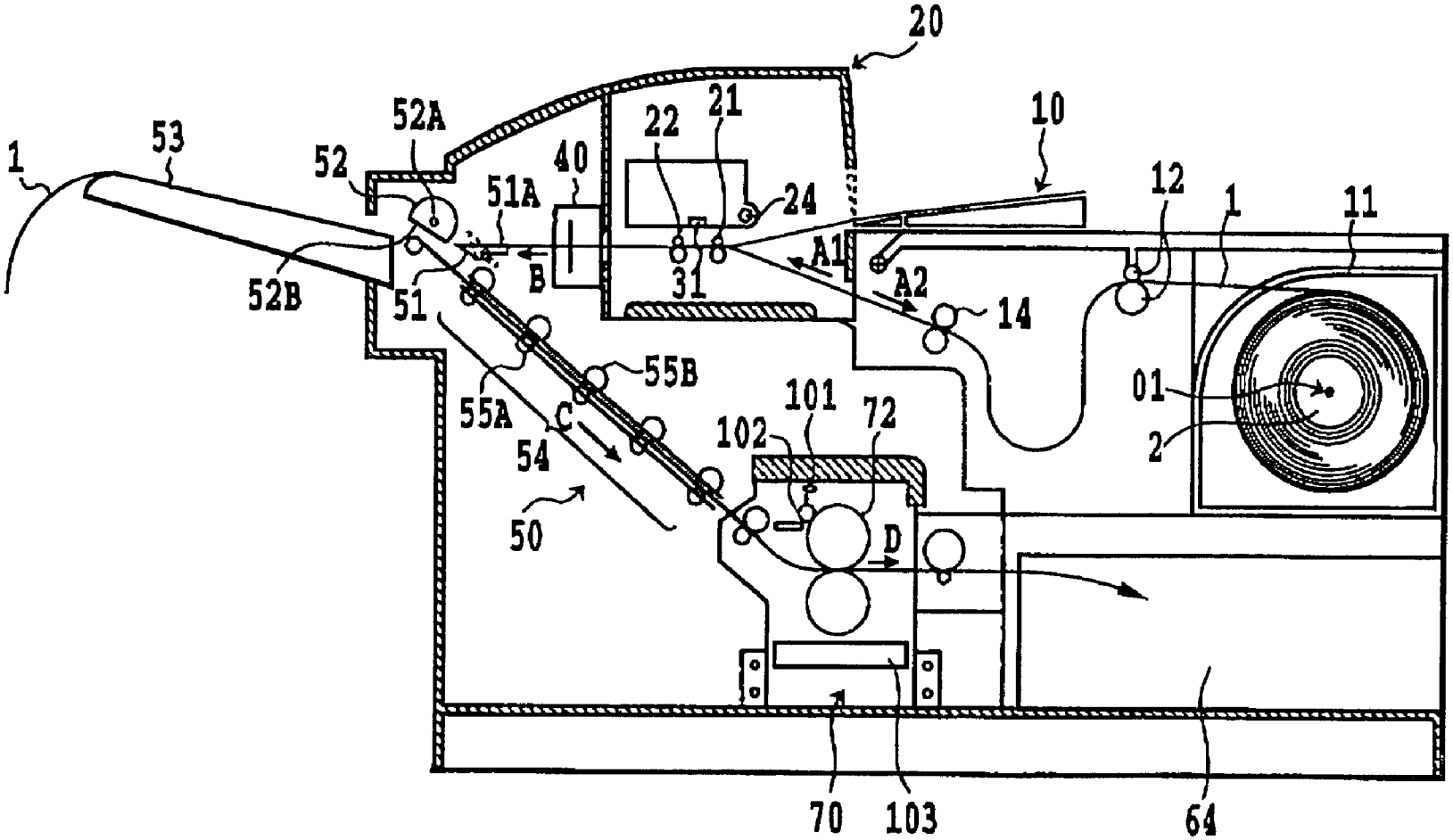
FIG. 8 is an explanatory, vertical cross-sectional side view showing one embodiment of an image printing apparatus according to the present invention.

The image printing apparatus of this embodiment incorporates a coating liquid application apparatus shown in one of the first to sixth embodiments and has a construction as shown in FIG. 8.

In FIG. 8, the image printing apparatus has a guide 10 for manually inserting a print medium and a cartridge 11 accommodating a roll R of a print medium strip wound on a paper core 2. The paper core 2 is supported to be rotatable about its axis O1. The print medium 1 payed out from the roll R is passed between roller pairs 12, 14 and fed to a print unit 20 which has a print head 31.

For manual feeding, a cut print medium is put on the manual insertion guide 10 for insertion into the image printing apparatus body. More specifically, when a manual insertion is selected by a controller that controls the image printing apparatus, the print medium from the roll is moved back in the direction of arrow A2 to the roller pair 14, after which the feeding of a print medium inserted from the manual insertion guide 10 is made valid. Then, whichever of the print mediums is selected is printed with an image by an ink ejected from nozzles of the ink jet print head 31 as it travels between a feed roller pair 21 and an auxiliary feed roller pair 22.

The ink jet print head 31 uses, for example, thermal energy to eject ink from the nozzles. For this purpose, the print head 31 is provided with electrothermal transducers, one for each nozzle. Each electrothermal transducer generates heat by a drive pulse supplied according to print data, causes a film boiling in the ink by the heat produced, and ejects an ink droplet from a corresponding nozzle by the growth of a bubble caused by the film boiling. Another type of ink jet print head 31 currently in wide use employs, for example, an electromechanical transducer, such as a piezoelectric element, that changes its volume upon application of electric energy to eject ink from each of the nozzles.

Denoted 40 is a cutter unit as a cutting means provided downstream of the print unit 20. The cutter unit 40, when the print medium is supplied from the roll, cuts the print medium 1 formed with an image by the print unit 20 to a predetermined length with a cutter. Designated 50 is a speed adjusting means which adjusts the speeds of the print mediums that have been fed at different speeds between the print unit 20 and the cutter unit 40. After receiving the print medium 1 printed by the print unit 20, the speed adjusting means 50 forwards it to a coating liquid application unit 70 (described later). A selection lever 51, which is pivotable about a shaft 51A, can be selectively switched between a rotary position shown in a solid line and a rotary position shown in a dashed line. Further, when the printed medium 1 is discharged in a direction of arrow B, the selection lever 51 is set to the solid line rotary position.

Designated 52 is a D-cut roller shaped like a letter D in cross section which is supported reciprocally pivotable about a shaft 52A. When the printed medium 1 is discharged in the arrow B direction, the D-cut roller 52 is set to have its flat cut surface 52B assume a rotary position shown. An intermediary tray 53 is removable and adapted to receive a printed medium 1. The intermediary tray 53 has a length almost equal to a width of A4-size paper. When an elongate print medium 1 is placed on it, a part of the print medium droops down from the end of the intermediary tray 53, as shown.

The print medium 1, after being printed by the print unit 20, is fed to the intermediary tray 53, from which it is fed into a transport path 54 (described later) by the selection lever 51 pivoted to the dashed line rotary position and by the counterclockwise-pivoted D-cut roller 52. The speed adjusting means 50 has the transport path 54 for leading the print medium 1 to the coating liquid application unit 70 (described later).

The transport path 54 comprises a plurality of roller pairs 55 and a pair of guide plates. The rollers 55A, 55B are driven by a motor (not shown) to feed the printed medium 1 in the direction of arrow C.

Denoted 70 is a coating liquid application unit which is basically the coating liquid application apparatus of one of the first to fourth embodiments and is incorporated in the image printing apparatus as a constitutional unit. That is, the coating liquid application unit 70 has a construction similar to those of the preceding embodiments including an application roller 72A, a feed roller 72B, a coating liquid tank 103 containing a coating liquid 100, a drip member 101 for dripping the coating liquid, and a application restriction roller 102 for restricting the amount of coating liquid to be applied. The print medium 1 applied with the coating liquid is transported in the direction of arrow D and discharged onto a tray 64.

In the image printing apparatus of this invention with the above-described construction, the print medium after being ink-jet-printed is automatically applied with the coating liquid to enhance its weatherability. Further, since the construction required to realize this feature is very simple, with only the coating liquid application apparatus installed at the end of the transport path of the print medium, the image printing apparatus can be manufactured with reduced cost.

As described above, the present invention can automatically and properly apply the coating liquid for improving characteristics of the printed surface of a print medium such as weatherability and, when compared with the method of laminating the printed surface with a film, can significantly reduce a burden imposed on the user as well as the running cost.

In a system where a coloring material adhering to an ink reception layer exhibits its color clearly or with high color saturation, the present invention can fill voids remaining in the ink reception layer after printing and thereby eliminate sites where the coloring material may undergo degradation reactions. Further, where a coating liquid with a high viscosity is used, this invention also makes it possible to uniformly apply an intended amount of the coating liquid to the image surface without a trouble.

With an application tool, kit and apparatus of this invention and with a protection method using these, it is possible to protect a printed image on a print medium easily and with high operability of the apparatus and to allow the user to enjoy directly seeing the protected original image.

Further, in the image protection processing using the protection liquid, the invention can be applied to the following sizes of print mediums:

Photograph size called an L size (89 mm×119 mm)

Post card (100 mm×148 mm)

2L size (double the L size) (119 mm×178 mm)

A4 size (210 mm×297 mm)

A3 size (420 mm×297 mm)

A1 size (840 mm×594 mm)

A0 size (840 mm×1188 mm)

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A coating liquid application apparatus for applying a coating liquid to a print medium printed with an ink image, the apparatus comprising:

a pair of rollers in rotating contact with both surfaces of the print medium, one of the rollers in contact with a printed surface of the print medium being used as an application roller, wherein a tank containing the coating liquid to be supplied into the application roller is arranged on a side surface of the application roller, and the tank has a liquid supply port through which to supply the coating liquid into the tank and a closing body for hermetically closing the liquid supply port, and wherein the application roller has fine holes in the surface thereof through which the coating liquid supplied into the interior of the roller seeps out to the surface.

2. A coating liquid application apparatus according to claim 1, wherein the application roller has the surface thereof formed of a film having the fine holes and has arranged therein an absorber formed of fibers or a foamed sponge body.

3. A coating liquid application apparatus according to claim 2, wherein the holes formed in the film are 0.1–0.5 micron in diameter.

4. A coating liquid application apparatus according to claim 2, wherein the application roller causes the coating liquid supplied from a side of a central portion thereof to seep out to the surface.

5. A coating liquid application apparatus according to claim 4, wherein the tank has an inclined bottom so that the coating liquid flows by gravity along the inclined bottom of the tank into the application roller.

6. A coating liquid application apparatus according to claim 4, wherein the tank is made of a transparent member that allows a level of the coating liquid in the tank to be visually checked from outside.

7. A coating liquid application apparatus according to claim 4, wherein the roller opposing the application roller has an oil-repellent surface.

8. A coating liquid application apparatus for applying a coating liquid to a print medium printed with an ink image, the apparatus comprising:

a pair of rollers in rotating contact with both surfaces of the print medium, one of the rollers in contact with a printed surface of the print medium being used as an application roller, wherein a tank containing the coating liquid to be supplied into the application roller is arranged on a side surface of the application roller, and the tank has a liquid supply port through which to supply the coating liquid into the tank and a closing body for hermetically closing the liquid supply port, wherein the application roller has fine holes in the surface thereof through which the coating liquid supplied into the interior of the application roller seeps out to the surface; and means for controlling the application roller to stop in a rotary angular range such that the liquid supply port of the tank rests at a position higher than the level of the coating liquid in the tank.

* * * * *